US008519930B2

(12) United States Patent
Luo et al.

(10) Patent No.: US 8,519,930 B2
(45) Date of Patent: Aug. 27, 2013

(54) FIELD SEQUENTIAL LIQUID CRYSTAL DISPLAY DEVICE AND METHOD

(75) Inventors: Xixi Luo, Shanghai (CN); Jun Ma, Shanghai (CN); Kang Yang, Shanghai (CN)

(73) Assignee: Shanghai Tianma Micro-Electronics Co., Ltd., Shanghai (CN)

( * ) Notice: Subject to any disclaimer, the term of this patent is extended or adjusted under 35 U.S.C. 154(b) by 0 days.

(21) Appl. No.: 13/325,898

(22) Filed: Dec. 14, 2011

(65) Prior Publication Data

US 2012/0169705 A1 Jul. 5, 2012

(30) Foreign Application Priority Data

Dec. 31, 2010 (CN) ..... 2010 1 0619935

(51) Int. Cl.
*G09G 3/36* (2006.01)

(52) U.S. Cl.
USPC ..... 345/92; 345/87; 345/212

(58) Field of Classification Search
USPC ..... 345/87–104, 204–215, 690–699; 349/42–48
See application file for complete search history.

(56) References Cited

U.S. PATENT DOCUMENTS

| | | | | |
|---|---|---|---|---|
| 7,978,277 | B2 * | 7/2011 | Kimura | 349/48 |
| 8,035,596 | B2 * | 10/2011 | Sekine | 345/92 |
| 2008/0170022 | A1 * | 7/2008 | Chen et al. | 345/92 |
| 2008/0174532 | A1 * | 7/2008 | Lewis | 345/85 |

* cited by examiner

*Primary Examiner* — Nitin Patel
*Assistant Examiner* — Robin Mak
(74) *Attorney, Agent, or Firm* — Harness, Dickey & Pierce, P.L.C.

(57) ABSTRACT

A field sequential liquid crystal display device includes: first, second, third and fourth thin film transistors, a frame buffer capacitor, a storage capacitor and a holding capacitor connected to the storage capacitor in parallel. The gate of first thin film transistor is connected to a gate line, the source thereof is connected to a data line, the drain thereof is connected to the source of second thin film transistor; the source of second thin film transistor is connected to one end of frame buffer capacitor, the drain thereof is connected to the drain of third thin film transistor; the other end of frame buffer capacitor and a source of third thin film transistor are connected to the drain of fourth thin film transistor, the source of fourth thin film transistor is grounded; and the drain of second thin film transistor is connected to one end of storage capacitor.

11 Claims, 5 Drawing Sheets

FIELD SEQUENTIAL LIQUID CRYSTAL DISPLAY DEVICE AND METHOD

FIELD OF THE INVENTION

This application claims the benefit of China Patent Application No. 201010619935.X filed on Dec. 31, 2010. The disclosure of the above application is incorporated herein by reference.

The present invention relates to the field of semiconductor manufacturing technique, and more particularly to a field sequential liquid crystal display device and a method for driving the same.

BACKGROUND OF THE INVENTION

A conventional Liquid Crystal Display device (LCD) performs the display based on a spatial color mixing principle, on which a color filter is generally configured. However, in a new field sequential LCD, the display is performed based on a time color mixing principle, that is to say, the three primary colors of the light, i.e. Red (R), Green (G) and Blue (B), are separated along the time axis, and quick switching among pixels of each primary color as time goes on, to display a color image on a screen.

When the field sequential LCD displays a color image, it should be generally noted is the problem about synchronization, coexistence and occupation between the flashing time of a backlight and the scanning time of a gate line on a liquid crystal substrate. In a common existing field sequential LCD, the flashing starting time of the backlight is selected to be after the last line scanning of each sub-frame is finished, and the flashing ending time may be before or after the first line scanning of the next frame is started. No matter which flashing time manner is adopted, there is always color mixing phenomenon. Taking the gate lines scanning along the screen from up to down as an example, when the backlight is turn on, the liquid crystal molecules in the upper portion of the screen have already deflected sufficiently, and the optimal color display can be obtained by turning on the backlight at this time. However, there is not enough response time for the liquid crystal molecules in the lower portion of the screen, and therefore deviation of the color display will be caused in the current frame; and on the contrary, this contributes to the color display of the next frame to a certain extent due to the asynchronization in the response time. This is referred to as the color mixing problem in the field sequential LCD display. If the flashing ending time of the backlight is selected to be before the starting of the first line scanning of the next frame, then the flashing time of the backlight and the scanning time of the gate line do not coexist totally. Referring to FIG. 1, FIG. 1 is a schematic diagram showing the non-coexisting relation between the flashing time of the backlight and the scanning time of the gate line. As shown in FIG. 1, the oblique line indicates the process of scanning the gate lines from the first line to the Nth line, and the rectangles indicate the backlights flashing with different colors. As shown in the Figure, in the case that the frame rate is fixed, if the flashing time of the backlight is too short, the lightness of the emergent light is not enough; and if the scanning time of the gate line is too short, the charging performed on the pixel electrode is not enough and gray scale is distorted. If the flashing ending time of the backlight is selected to be after the starting of the first line scanning of the next frame, the flashing time of the backlight and the scanning time of the gate line coexist partly or mostly, and this will aggravate the above mentioned color mixing phenomenon.

To solve the problem of the color mixing in the field sequential LCD display, a new field sequential LCD, i.e. a Frame buffer (Fb) field sequential LCD is provided. Referring to FIG. 2 and FIG. 3, FIG. 2 is a schematic diagram of a pixel structure of a common field sequential LCD; and FIG. 3 is a schematic diagram of a pixel structure of an Fb field sequential LCD. The pixel structure of the common field sequential LCD includes a Thin Film Transistor (TFT), a storage capacitor $C_{st}$ and a holding capacitor $C_{lc}$, in which the gate of the TFT is connected to a gate line, the source thereof is connected to a data line, and the drain thereof is connected to the storage capacitors $C_{st}$, and the storage capacitor $C_{st}$ and the holding capacitor $C_{lc}$ are connected in parallel and are respectively connected to the ground. Compared with the common field sequential LCD, the Fb field sequential LCD further includes a TFT and a frame buffer capacitor $C_{fb}$. The pixel structure of this Fb field sequential LCD includes a TFT1, a TFT2, a frame buffer capacitor $C_{fb}$, a storage capacitor $C_{st}$ and a holding capacitor $C_{lc}$, in which the gate of the TFT1 is connected to a gate line, the source thereof is connected to a data line, and the drain thereof is connected to the source of the TFT2 and an end of the frame buffer capacitor $C_{fb}$, and the other terminal of the frame buffer capacitor $C_{fb}$ is connected to the ground; and the gate of the TFT2 is connected to a Video Synchronization signal (Video Sync, VS), the drain thereof is connected to the storage capacitors $C_{st}$, and the storage capacitor $C_{st}$ and the holding capacitor $C_{lc}$ are connected in parallel and are respectively connected to the ground.

Referring to FIG. 3, in the gate line scanning, the TFT2 is cut off under the control of the video synchronization signal, and in this case, the gray scale voltage signal of the present frame is still applied to the pixel electrode and the display is performed normally, that is to say, the gray scale voltage signal of the next frame that will be input into the pixel electrode is stored in the frame buffer capacitor $C_{fb}$. After one frame has been scanned, all the TFT2s conduct under the control of a high-pulse of the video synchronization signal shared by the whole screen, the voltage signal stored in the frame buffer capacitor $C_{fb}$ enters into the pixel electrode via the channel of TFT2, and all of the TFT2s are cut off after the pixel electrode has been charged. Then the next frame starts to be scanned by the gate lines. This scanning will not affect the electric potential of the pixel electrode because the TFT2 is cut off, meanwhile normal display of the current frame is being performed on the pixel electrode.

FIG. 4 is a schematic diagram of coexisting relation between the scanning time of the gate lines and the flashing time of the backlight in an Fb field sequential LCD. Referring to FIG. 4, the oblique line indicates the process for scanning the gate lines from the first line to the Nth line sequentially, and in this case, TFT1 in each pixel conducts and the signal is inputted sequentially through the date line to charge the frame buffer capacitor $C_{fb}$. It can be seen from the Figure that, the scanning time of the gate line and the flashing time of the backlight overlap completely, and the occupation does not exist, so that the charging of the pixel electrode and the flashing of the backlight are sufficient. Therefore, the Fb field sequential LCD can solve the problem of the distribution of the scanning time of the gate line and the flashing time of the backlight, so that the problem of color mixing can be solved.

However, the Fb field sequential LCD also has its own disadvantages. Electric potential analysis will be performed on the pixel electrode of the Fb field sequential LCD hereinafter. Referring to FIG. 3, it is assumed that the electric potential of the pixel electrode of the current frame is $V_1$, and a voltage signal $V_2$ of the next frame is input to the frame buffer capacitor $C_{fb}$ by the gate line scanning, in this way, when the TFT2 is turn on, the electric potential on the pixel electrode will be $V_1'$, and the following formula can be obtained:

$$V_1(C_{lc}+C_{st})+V_2C_{fb}=V_1'(C_{fb}+C_{st}+C_{lc}) \quad (1)$$

the following two formulas can be obtained by deducing according to the formula (1):

$$V_1' = V_1 + \frac{(V_2 - V_1)C_{fb}}{C_{fb} + C_{st} + C_{lc}} \quad (2)$$

$$V_2 - V_1' = \frac{(V_2 - V_1)(C_{st} + C_{lc})}{C_{fb} + C_{st} + C_{lc}} \quad (3)$$

During the process of displaying on the Fb field sequential LCD, the Gamma curve of the common driving IC requires an one-to-one correspondence relation between the pixel electrode voltage and the output voltage, that is to say, it is desired that when obtaining a specific pixel electrode voltage, there is only one specific value of the output voltage that corresponds to the pixel electrode voltage. The formula (3) is represented as that: when $V_2$ and $V_1'$ are determined, the difference between $V_2$ and $V_1'$ should be a fixed value (in other words, the difference between $V_2$ and $V_1'$ is a function only dependent on $V_1'$). However, in the formula (3) that is deduced from the pixel electrode structure of the Fb field sequential LCD, when $V_2$ and $V_1'$ are determined, the difference between $V_2$ and $V_1'$ varies with the variance of $V_1$, rather than a fixed value. That is to say, in the case that the same $V_2$ is output, the practical voltage on the pixel electrode will be affected by $V_1$, which be presented on the image as the current frame with the afterimage of the last frame. That is to say, the afterimage will always exist, so as to reduce the image display quality.

SUMMARY OF THE INVENTION

In view of this, the present invention provides a field sequential liquid crystal display device and a method for driving the same. This device can solve effectively the problem of afterimage on Fb field sequential LCD and contributes to improve the image display quality.

In order to achieve the above objects, the present invention provides the following technical solutions.

The present invention provides a field sequential liquid crystal display device, and a pixel structure of the device includes a first thin film transistor, a second thin film transistor, a third thin film transistor, a fourth thin film transistor, a frame buffer capacitor, a storage capacitor and a holding capacitor;

in which the gate of the first thin film transistor is connected to a gate line, the source of the first thin film transistor is connected to a data line, and the drain of the first thin film transistor is connected to the source of the second thin film transistor;

the source of the second thin film transistor is connected to an end of the frame buffer capacitor, and the drain of the second thin film transistor is connected to the drain of the third thin film transistor;

the other end of the frame buffer capacitor and the source of the third thin film transistor are connected to the drain of the fourth thin film transistor, and the source of the fourth thin film transistor is connected to the ground; and the drain of the second thin film transistor is also connected to an end of the storage capacitor, the other end of the storage capacitor is ground, and the storage capacitor and the holding capacitor are connected in parallel.

Preferably, in the above field sequential liquid crystal display device, the gate of the second thin film transistor is connected to a video synchronization signal, the gate of the third thin film transistor is connected to a cleaning signal, and the gate of the fourth thin film transistor is connected to a grounding control signal.

Preferably, in the above field sequential liquid crystal display device, a relationship between a pixel electrode voltage and an output voltage is:

$$V_1' = \frac{V_2C_{fb}}{C_{fb} + C_{st} + C_{lc}};$$

in which $V_1'$ is the pixel electrode voltage, $V_2$ is the output voltage, $C_{fb}$ is the capacitance of the frame buffer capacitor, $C_{st}$ is the capacitance of the storage capacitor, and $C_{lc}$ is the capacitance of the holding capacitor.

Preferably, in the above field sequential liquid crystal display device, the second thin film transistor and the fourth thin film transistor are in a cut-off state, and the gate of the third thin film transistor is connected to the gate line and receives a scanning signal.

Preferably, in the above field sequential liquid crystal display device, a relationship between a pixel electrode voltage and an output voltage is:

$$V_1' = \frac{V_2C_{fb}}{C_{fb} + C_{st} + C_{lc}};$$

in which $V_1'$ is the pixel electrode voltage, $V_2$ is the output voltage, $C_{fb}$ is the capacitance of the frame buffer capacitor, $C_{st}$ is the capacitance of the storage capacitor, and $C_{lc}$ is the capacitance of the holding capacitor.

Preferably, in the above field sequential liquid crystal display device, the grounding control signal is logic OR between a scanning signal and a zero clearing signal.

The present invention further provides a method for driving a field sequential liquid crystal display device, and the method includes:

providing a grounding control signal for the gate of a fourth thin film transistor;

providing a scanning signal for the gate of a first thin film transistor, providing a data signal for the source of the first thin film transistor, and performing frame scanning;

providing a zero clearing signal for the gate of a third thin film transistor to clear a pixel electrode voltage after finishing one frame scanning; and providing a video synchronization signal for the gate of a second thin film transistor to display an image after finishing the zero clearing.

Preferably, in the above method for driving the field sequential liquid crystal display device, the grounding control signal is logic OR between the scanning signal and the zero clearing signal.

The present invention further provides another method for driving the field sequential liquid crystal display device, and the method includes:

providing a scanning signal for the gate of a first thin film transistor, providing a data signal for the source of the first thin film transistor, and meanwhile providing the scanning signal for the gate of the third thin film transistor.

It can be seen from the above technical solutions that, in the field sequential liquid crystal display device provided by the present invention, the pixel structure thereof adds a third thin film transistor and a fourth thin film transistor compared with the Fb field sequential LCD. When a scanning signal is input to the gate of the first thin film transistor TFT1, the fourth thin film transistor TFT4 can conduct under the control and the frame buffer capacitance $C_{fb}$ is charged; after one frame scanning is finished, the third thin film transistor TFT3 can conduct under the control of a zero clearing signal CLR, and in this case, the fourth thin film transistor TFT4 also conduct under the control and the pixel electrode voltage is cleared; and then the second thin film transistor TFT2 conducts under the control of the video synchronization signal and the pixel electrode is charged by the charge stored in the frame buffer capacitor $C_{fb}$. Because the pixel electrode has been zero cleared before being charged, the voltage of the charged pixel electrode is not affected by the last frame voltage, so that the problem of the afterimage can be solved and the quality of the image display can be improved.

BRIEF DESCRIPTION OF THE DRAWINGS

In order to illustrate the technical solutions in the embodiments of the present invention or in the prior art more clearly, drawings that are to be used in describing the prior art or the embodiments will be described briefly hereinafter. Apparently, the drawings described hereinafter are only some embodiments of the present invention, and other drawings may be obtained by those skilled in the art according to those drawings without creative work.

DETAILED DESCRIPTION OF THE INVENTION

The present invention will be described in detail hereinafter in conjunction with the drawings, so that it will be more clearly and easily for objects, technical solutions and advantages of the present invention to be understood.

To facilitate the sufficient understanding of the present invention, many specific details are explained in the following descriptions. However, the present invention may also be implemented in other modes different from those described herein, and similar extensions may be made by those skilled in the art without deviating from the spirit of the present invention. Therefore, the present invention is not restricted by the embodiments disclosed hereinafter.

Secondly, the present invention is described in detail in conjunction with schematic diagrams. In describing the embodiments of the present invention, to facilitate the illustration, the sectional view representative of the structure of the device will not be magnified locally in general proportion, and the shown schematic diagrams are only examples, which are not meant to restrict the scope of protection of the present invention. Furthermore, a three-dimensional space dimension in length, width and depth should be included in practical manufacturing.

First Embodiment

As described in the background of the invention, in a common field sequential LCD, there is always color mixing phenomenon due to the problems of matching and distributing of the flashing time of the backlight and the scanning time of the gate line. Although an Fb field sequential LCD can solve the problems of matching and distributing of the flashing time of the backlight and the scanning time of the gate line, so that the problem of color mixing is solved, an afterimage will be produced during the image display so as to reduce the quality of the image display.

Figure 5:
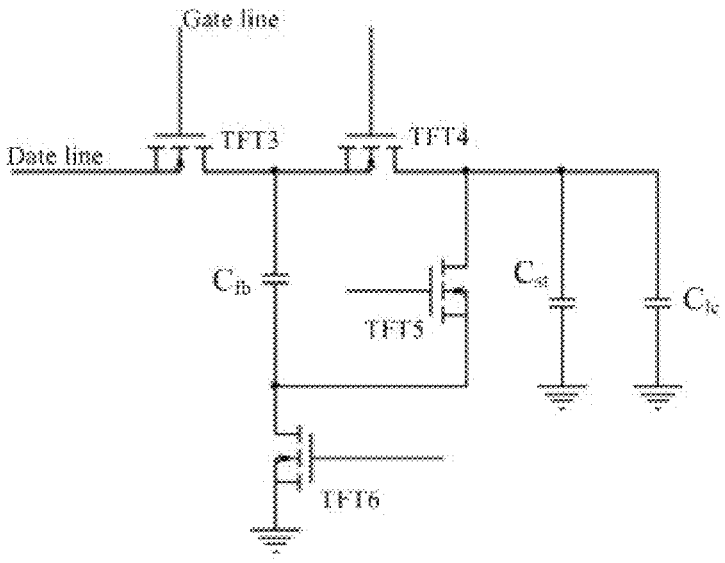
FIG. 5 is a schematic diagram of a pixel structure of a field sequential liquid crystal display device provided by an embodiment of the present invention.

On this account, the present invention provides a field sequential liquid crystal display device. Referring to FIG. 5, FIG. 5 is a schematic diagram of a pixel structure of a field sequential liquid crystal display device provided by an embodiment of the present invention. The pixel structure of the device includes a first thin film transistor TFT3, a second thin film transistor TFT4, a third thin film transistor TFT5, a fourth thin film transistor TFT6, a frame buffer capacitor $C_{fb}$, a storage capacitor $C_{st}$ and a holding capacitor $C_{lc}$. Particularly, the gate of the first thin film transistor TFT3 is connected to a gate line to receive a scanning signal, the source thereof connected to a data line, and the drain thereof is connected to the source of the second thin film transistor TFT4; the source of the second thin film transistor TFT4 is connected to an end of the frame buffer capacitor $C_{fb}$, and the drain thereof is connected to the drain of the third thin film transistor TFT5; the other end of the frame buffer capacitor $C_{fb}$ and the source of the third thin film transistor TFT5 are connected to the drain of the fourth thin film transistor TFT6, and the source of the fourth thin film transistor TFT6 is grounded; and the drain of the second thin film transistor TFT4 is also connected to an end of the storage capacitor $C_{st}$, the other end of the storage capacitor $C_{st}$ is grounded, and the storage capacitor $C_{st}$ and the holding capacitor $C_{lc}$ are connected in parallel.

Figure 6:
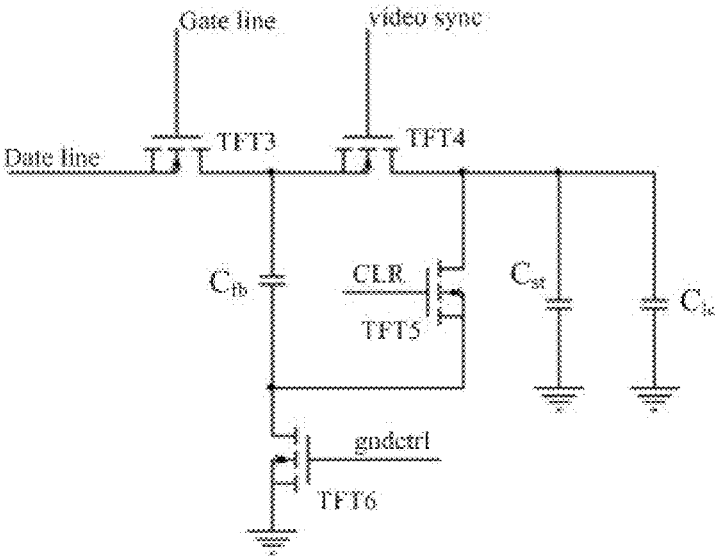
FIG. 6 is a schematic diagram of a pixel structure of a field sequential liquid crystal display device working in an Fb mode provided by an embodiment of the present invention.

Referring to FIG. 6, FIG. 6 is a schematic diagram of a pixel structure of a field sequential liquid crystal display device working in an Fb mode provided by an embodiment of the present invention. Compared with the Fb field sequential LCD (referring to FIG. 3), the pixel structure of the field sequential liquid crystal display device provided by an embodiment of the present invention adds two thin film transistors, i.e., a third thin film transistor TFT5 and a fourth thin film transistor TFT6. Particularly, the drain of the third thin film transistor TFT5 is connected to the drain of the second thin film transistor TFT4 (corresponding to the TFT2 in FIG. 3), the source of the third thin film transistor TFT5 is connected to the end of the frame buffer capacitor $C_{fb}$ (corresponding to the end being grounded in FIG. 3), the source of the third thin film transistor TFT5 is connected to the drain of the fourth thin film transistor TFT6, and the source of the fourth thin film transistor TFT6 is grounded. When the field sequential liquid crystal display device provided by an embodiment of the present invention works in the Fb mode, the gate of the first thin film transistor TFT3 that is connected to the gate line is adapted to receive a scanning signal, the gate of the second thin film transistor TFT4 is adapted to receive a video synchronization signal (video sync), the gate of the third thin film transistor TFT5 is adapted to receive a zero clearing signal CLR, and the gate of the fourth thin film transistor TFT6 is adapted to receive a grounding control signal gndctrl. In this embodiment of the present invention, the grounding control signal gndctrl is logic OR between the scanning signal and the zero clearing signal CLR. When the scanning signal is input to the gate of the first thin film transistor TFT3, the first thin film transistor TFT3 conducts to receive a data signal, and the fourth thin film transistor TFT6 also conducts, and an end of the frame buffer capacitor $C_{fb}$ is grounded, so as to charge the frame buffer capacitor $C_{fb}$ by the data signal. In this case, the second thin film transistor TFT4 and the third thin film transistor TFT5 are in a cut-off state; and after one frame scanning is finished, the first thin film transistor TFT3 is cut off, and the third thin film transistor TFT5 conducts under the control of the zero clearing signal CLR, and at this time, the fourth thin film transistor TFT6 also conducts, the pixel electrode is grounded, and the pixel electrode voltage is clear. After that, the third thin film transistor TFT5 and the fourth thin film transistor TFT6 are cut off, and the second thin film transistor TFT4 conducts under the control of the video synchronization signal video sync, so as to charge the pixel electrode by the charge stored in the frame buffer capacitor $C_{fb}$. Because the pixel electrode has been zero cleared before being charged, the voltage of the charged pixel electrode is not affected by the last frame voltage, so that the problem of the afterimage can be solved and the quality of the image display is improved.

As can be seen from the above, the field sequential liquid crystal display device provided by the present invention is designed based on the Fb field sequential LCD, which adds two thin film transistors (a third thin film transistor TFT5 and a fourth thin film transistor TFT6 respectively) to the pixel structure of the Fb field sequential LCD. The problem of the color mixing in the common field sequential LCD is solved and the problem of afterimage in the Fb field sequential LCD is also overcame by controlling a corresponding driving signal.

The field sequential liquid crystal display device and the method for driving the same provided by the embodiments of the present invention will be described in detail hereinafter in conjunction with the drawings.

Second Embodiment

The first embodiment has described the field sequential liquid crystal display device provided by the present invention, the pixel structure of which is improved based on the pixel structure of the Fb field sequential LCD, so as to solve the problem of the color mixing in the common field sequential LCD and overcome the problem of the afterimage in the Fb field sequential LCD. Furthermore, the driving manner of the field sequential liquid crystal display device provided by the present invention is compatible with that of the common field sequential LCD, that is to say, the switch between the common field sequential LCD and the Fb field sequential LCD can be implemented by simply changing the applied driving signal.

Figure 1:
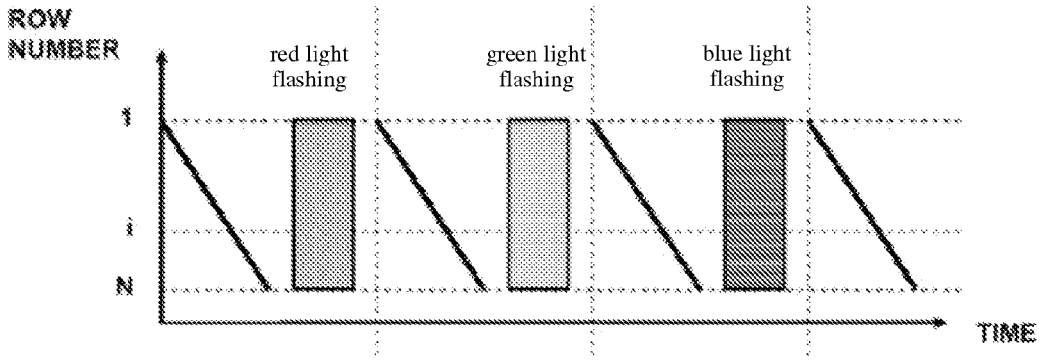
Fig. 1 (Prior Art)
FIG. 1 is a schematic diagram of non-coexisting relation between the flashing time of the backlight and the scanning time of the gate line in a field sequential liquid crystal display device according to the prior art.
Figure 2:
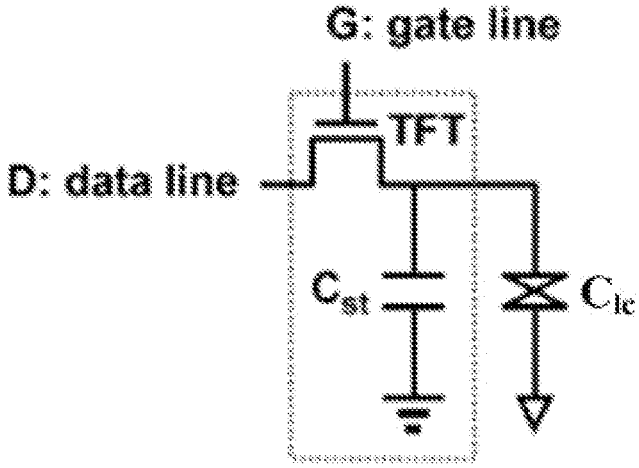
Fig. 2 (Prior Art)
FIG. 2 is a schematic diagram of a pixel structure of a common field sequential LCD in the prior art.
Figure 3:
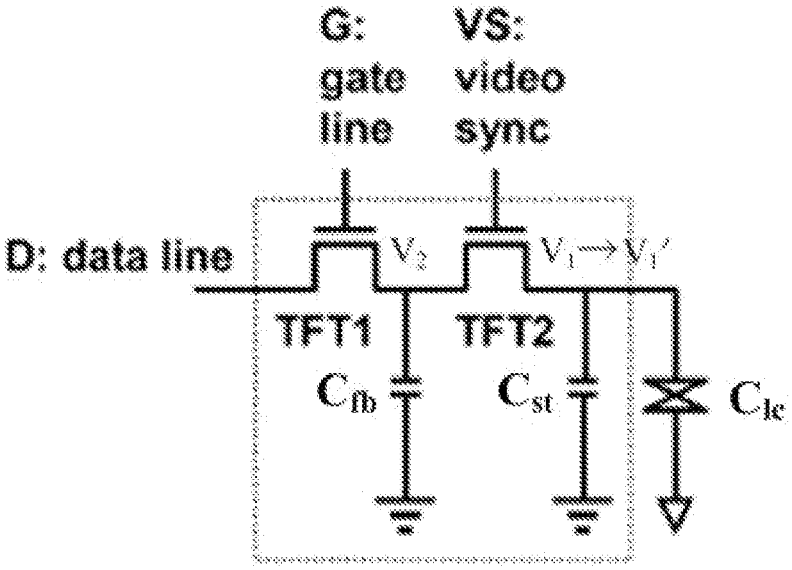
Fig. 3 (Prior Art)
FIG. 3 is a schematic diagram of a pixel structure of an Fb field sequential LCD in the prior art.
Figure 4:
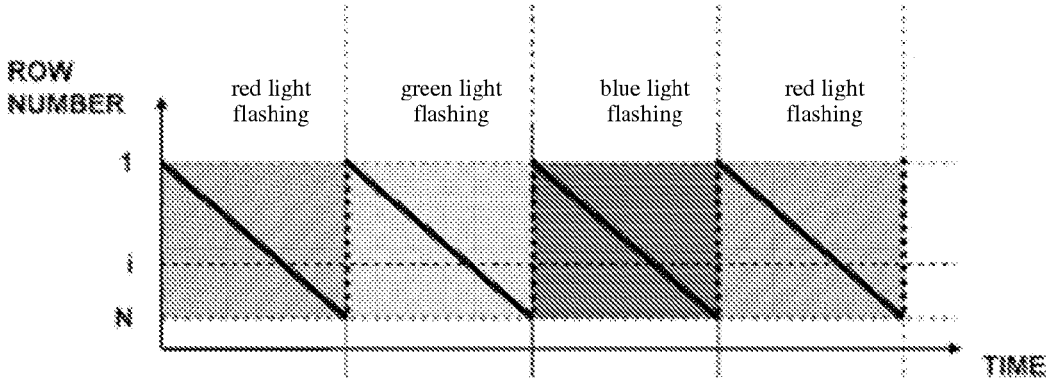
Fig 4 (Prior Art)
FIG. 4 is a schematic diagram of coexisting relation between the flashing time of the backlight and the scanning time of the gate line in an Fb field sequential LCD according to the prior art.

Referring to FIG. 3 and FIG. 5, the pixel structure of the field sequential liquid crystal display device provided by the embodiments of the present invention adds two thin film transistors TFT5 and TFT6 to the pixel structure of the Fb field sequential LCD. Particularly, the source of the thin film transistor TFT5 is connected to the drain of the thin film transistor TFT6, the drain of the thin film transistor TFT5 is connected to the drain of the thin film transistor TFT4, and the source of the thin film transistor TFT6 is grounded; and the end of the frame buffer capacitor $C_{fb}$ that is grounded in the pixel structure of the Fb field sequential LCD is now connected to the source of the thin film transistor TFT5. The connecting manners among the thin film transistors TFT3 (corresponding to the TFT1 in FIG. 3), TFT4 (corresponding to the TFT2 in FIG. 3), the storage capacitor $C_{st}$, the holding capacitor $C_{lc}$ and the like are the same as those in FIG. 3.

In the following, the field sequential liquid crystal display device provided by the present invention changes the driving signal applied thereon to implement the switch between the common field sequential LCD and the Fb field sequential LCD.

Figure 7:
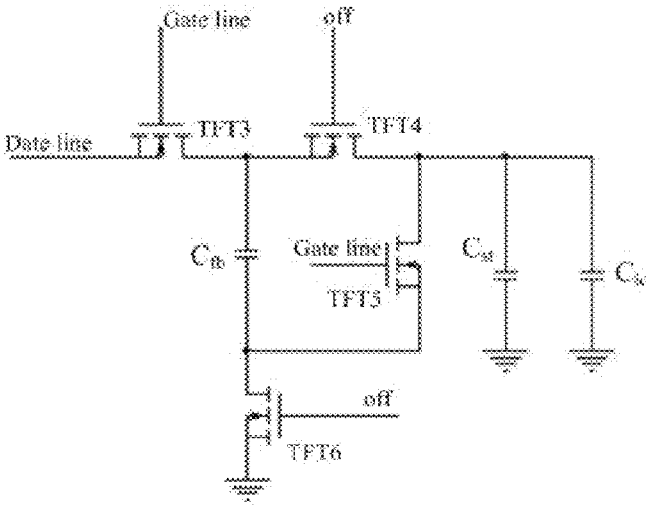
FIG. 7 is a schematic diagram of a pixel structure of a field sequential liquid crystal display device working in a common mode provided by an embodiment of the present invention.

Referring to FIG. 7, FIG. 7 is a schematic diagram of a pixel structure of a field sequential liquid crystal display device working in a common mode provided by an embodiment of the present invention. It can be seen from the Figure that, when working in the common mode, the thin film transistors TFT3 and TFT5 in this pixel structure are controlled by a scanning signal. A driving control signal is not applied on the gates of the thin film transistor TFT4 and the thin film transistor TFT6, that is to say, the thin film transistors TFT4 and TFT6 are always in the cut-off state. In this way, the thin film transistors TFT3 and TFT5 are turn on under the control of the scanning signal during the line frequency, and thus the equivalent circuit structure of the pixel electrode is that: the storage capacitor $C_{st}$ and the holding capacitor $C_{lc}$ which are connected in parallel are connected to the frame buffer capacitor $C_{fb}$ in series. When the data signal inputs a signal with voltage of $V_2$ into the frame buffer capacitor $C_{fb}$, according to the voltage distribution principle of the series capacitors, the voltage on the pixel electrode $V_1'$ is:

$$V_1' = \frac{V_2 C_{fb}}{C_{fb} + C_{st} + C_{lc}} \tag{4}$$

In this way, in the point reversion mode, the fixed proportional relation between the pixel electrode voltage $V_1'$ and the output voltage $V_2$ is conformed to the ability of driving IC Gamma curve adjusting function.

Figure 8:
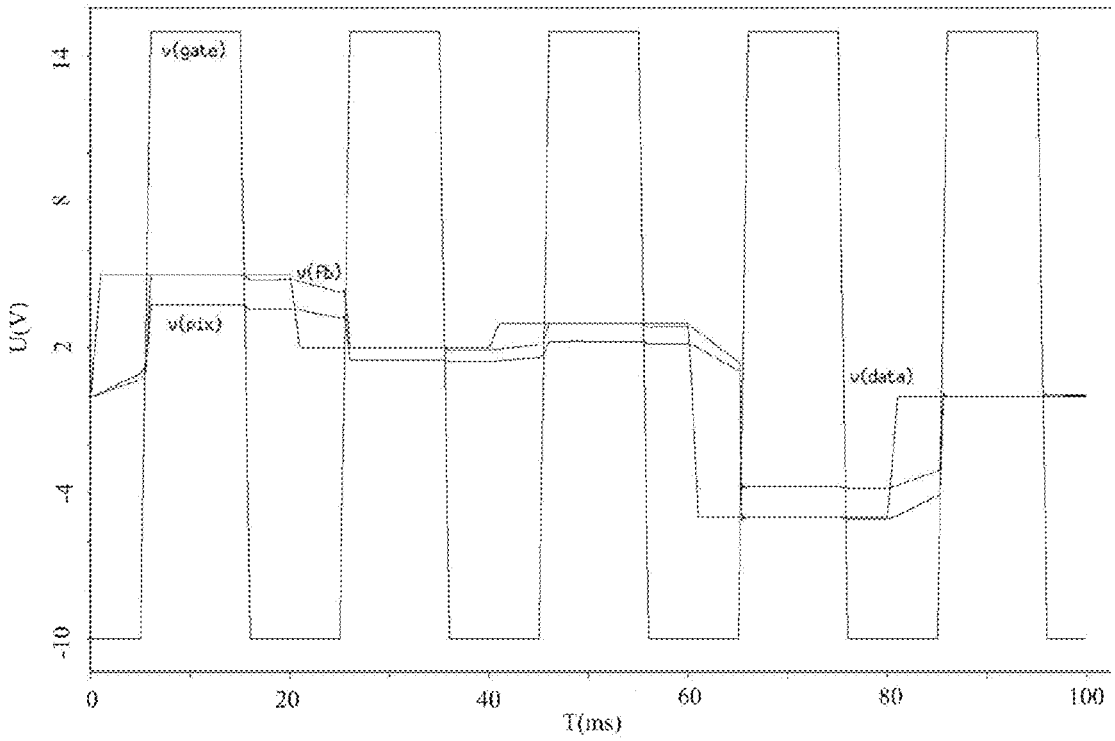
FIG. 8 is a diagram showing a voltage signal simulation result of a field sequential liquid crystal display device working in a common mode provided by an embodiment of the present invention.

Referring to FIG. 8, FIG. 8 is a diagram showing a voltage signal simulation result of a field sequential liquid crystal display device working in a common mode. It can been seen from the Figure that, in the case of the certain scanning signal voltage v(gate) and the certain data signal voltage v(data), the pixel electrode voltage v(pix) has the same variation tendency with the voltage v(fb) stored by the frame buffer capacitor, that is to say, those have a constant proportional relation.

Figure 9:
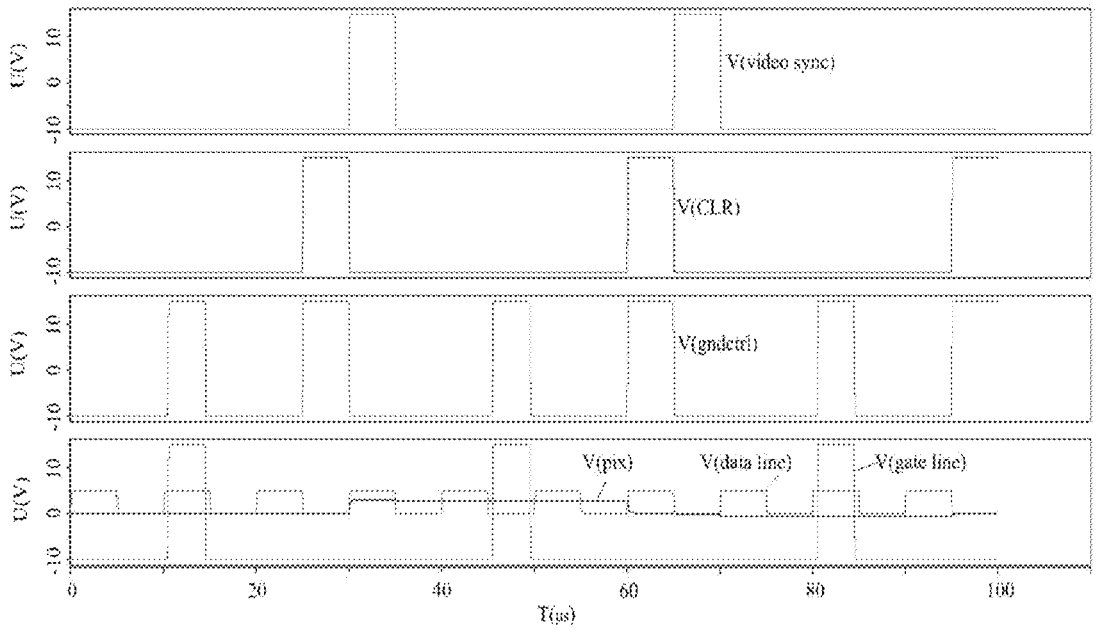
FIG. 9 is a time sequence diagram of a driving signal of a field sequential liquid crystal display device working in an Fb mode provided by an embodiment of the present invention.

Referring to FIG. 6 and FIG. 9, FIG. 6 is a schematic diagram of a pixel structure of a field sequential liquid crystal display device working in an Fb mode provided by an embodiment of the present invention, and FIG. 9 is a time sequence diagram of a driving signal of a field sequential liquid crystal display device working in an Fb mode provided by an embodiment of the present invention. It can been seen from the Figures that, when working in the Fb mode, the thin film transistor TFT3 in the pixel structure conducts during the line frequency under the control of the normal scanning signal, the thin film transistor TFT4 is controlled by the video synchronization signal video sync, the thin film transistor TFT5 is controlled by the full-screen zero clearing signal CLR, and the thin film transistor TFT6 is controlled by the grounding control signal gndctrl. The grounding control signal gndctrl is a high voltage when both the pulse of the scanning signal of the line on which the grounding control signal gndctrl is located and the pulse of the full-screen zero clearing signal CLR are coming, and otherwise it is a low voltage. That is to say, the grounding control signal gndctrl is logic OR between the scanning signal and the zero clearing signal CLR. When a scanning signal is inputted to the gate of the thin film transistor TFT3, the thin film transistor TFT3 conducts to receive the data signal, and the thin film transistor TFT6 also conducts, In this case, one end of the frame buffer capacitor $C_{fb}$ is grounded to charge the frame buffer capacitor $C_{fb}$ by the data signal, assuming the electric potential of the charged frame buffer capacitor $C_{fb}$ is the output voltage $V_2$, in this case, the thin film transistors TFT4 and TFT5 are cut off, and the pixel electrode voltage is the signal voltage of the last frame image, which is set as $V_1$. Once one frame scanning is finished, the thin film transistor TFT3 is cut off, and the thin film transistors TFT5 in all pixel electrodes conduct under the control of the high pulse of the full-screen zero clearing signal CLR. In this case, the thin film transistor TFT6 also conducts, and the pixel electrode is grounded to clear the pixel electrode voltage. After the zero clearing is finished, the thin film transistors TFT5 and TFT6 are cut off, and the thin film transistors TFT4 in all pixel electrodes conduct under the control of the high pulse of the full-screen video synchronization signal video sync, and then, the pixel electrode is charged by the charge stored in the frame buffer capacitor $C_{fb}$. Because the pixel electrode has been discharged under the control of the full-screen zero clearing signal CLR before it is charged by the frame buffer capacitor $C_{fb}$, so, $V_1=0$. $V_1=0$ is substituted to the formula (2), resulting $$V_1' = \frac{V_2 C_{fb}}{C_{fb} + C_{st} + C_{lc}} \tag{5}$$

It can be seen from the formula (5) that, the pixel electrode voltage $V_1'$ has a certain relation only with the output voltage $V_2$, and not affected by the last frame voltage $V_1$. That is to say, when the field sequential liquid crystal display device provided by the present invention works in the Fb mode, the problem of the afterimage can be solved so as to improve the quality of the image display.

It can be seen from the above analysis that, the pixel electrode voltage $V_1'$ has the same expression (the formula (4) and the formula (5) are the same expression) which is independent of the display mode of the field sequential liquid crystal display device. That is to say, an output voltage $V_2$ corresponds to a fixed pixel electrode voltage $V_1'$. That is to say, the driving IC Gamma curves in the two working modes are the same. Therefore, in the field sequential liquid crystal display device provided by the present invention, the working modes of the device can be switched by changing the control signal rather than changing the driving IC Gamma curve, and thus this method has the advantages of simplicity and convenience.

Third Embodiment

The embodiment of the present invention further provides a method for driving a field sequential liquid crystal display device, which has different driving manners during working in different mode. Specifically:

Referring to FIG. 7, when the field sequential liquid crystal display device provided by the present invention works in the common mode, the driving manner includes:

providing a scanning signal for the gate of a thin film transistor TFT3, providing a data signal for the source thereof, and providing a scanning signal for the gate of a thin film transistor TFT5.

Because the control signal is not applied on the gates of the thin film transistors TFT4 and TFT6, the thin film transistors TFT4 and TFT6 are always in the cut-off state. The thin film transistors TFT3 and TFT5 conduct during the line frequency under the control of scanning signal, and the equivalent circuit structure of the pixel electrode is that: the storage capacitor $C_{st}$ and the holding capacitor $C_{lc}$ connected in parallel are connected to the frame buffer capacitor $C_{fb}$ in series. In this case, compared with the pixel structure in FIG. 3, the pixel structure adds one frame buffer capacitor $C_{fb}$, and thus this driving manner is the driving manner of the common field sequential liquid crystal display device.

Referring to FIG. 6, when the field sequential liquid crystal display device provided by the present invention works in the Fb mode, the driving manner includes:

providing a grounding control signal for the gate of a thin film transistor TFT6, providing a scanning signal for the gate of a thin film transistor TFT3, providing a data signal for the source of the thin film transistor TFT3, and performing frame scanning, in which the thin film transistors TFT3 and TFT6 conduct; providing a zero clearing signal for the gate of the thin film transistor TFT5 to clear the pixel electrode voltage after finish one frame scanning, in which the thin film transistors TFT5 and TFT6 conduct; and providing a video synchronization signal for the gate of the thin film transistor TFT4 to display the image after the zero clearing, in which the thin film transistor TFT4 conducts. The grounding control signal in this embodiment is logic OR between the scanning signal and the zero clearing signal.

The thin film transistor TFT3 conducts during the line frequency under the control of the normal scanning signal, and in the meantime the thin film transistor TFT6 also conducts. In this case, one end of the frame buffer capacitor $C_{fb}$ is grounded and the frame buffer capacitor $C_{fb}$ is charged by the data signal; and the thin film transistors TFT4 and TFT5 are cut off, and the voltage of the pixel electrode is the signal voltage of the last frame image. After the one frame scanning is finished, the thin film transistor TFT5 conducts under the control of the zero clearing signal CLR at the gate of the thin film transistor TFT5, and the thin film transistor TFT6 also conducts, the pixel electrode is grounded, and the voltage of the pixel electrode is cleared. Then, the thin film transistors TFT5 and TFT6 are cut off, and the thin film transistor TFT4 conducts under the control of the video synchronization signal video sync at the gate thereof, so that the pixel electrode is charged by the charge stored in the frame buffer capacitor $C_{fb}$ through the channel of the thin film transistor TFT4. Because the pixel electrode has been discharged under the control of the zero clearing signal CLR before it is charged by the frame buffer capacitor $C_{fb}$, the pixel electrode voltage is not affected by the last frame voltage, i.e., there is no afterimage in the image.

Therefore, in the Fb mode, the field sequential liquid crystal display device provided by the present invention has the sufficient charging for pixel electrode and the sufficient flashing time of the backlight and the color mixing phenomenon is eliminated, so as to solve the problem of the afterimage and improve the quality of the image display.

In the present specification, the embodiments are described in progression, each embodiment mainly focuses on the distinction between itself and other embodiments, therefore, the descriptions are brief, and references can be made to those similar parts in the description of the device.

It is noted that, in the present invention, relation terms such as "first" and "second" are used only to distinguish one entity or operation from the other entity or operation, but not sure to demand or indicate that there are those actual relations or orders among those entities and operations. Furthermore, the terms "including", "comprising", or any other grammatical variations are used in the inclusive sense of "comprising", so that process, method, article or device that includes series of the elements include not only those elements but also other elements that are not listed, or further include inherent elements of this process, method, article or device. In the case of no more restriction, an element defined by the sentence "including one" does not indicate that there are no other same elements in the process, method, article or device that includes said element.

The above descriptions of the disclosed embodiments enable those skilled in the art to implement or use the present disclosure. Various modifications made to those embodiments will be obvious to those skilled in the art, and the ordinal principles defined in the present disclosure can be implemented in other embodiments without departing from the spirit or the scope of the present disclosure. Therefore, the present invention should not be limited to those embodiments disclosed herein, but should be in coincidence with the widest scope in accordance with the principles and the novel characteristics disclosed in the present invention.

What is claimed is:

1. A field sequential liquid crystal display device, wherein a pixel structure of the device comprises: a first thin film transistor, a second thin film transistor, a third thin film transistor, a fourth thin film transistor, each having a gate, a source, and a drain; a frame buffer capacitor; a storage capacitor; and a holding capacitor;

wherein the gate of said first thin film transistor is connected to a gate line, the source of said first thin film transistor is connected to a data line, and the drain of said first thin film transistor is connected to the source of the second thin film transistor;

the source of said second thin film transistor is connected to an end of the frame buffer capacitor, and the drain of said second thin film transistor is connected to the drain of the third thin film transistor;

the other end of said frame buffer capacitor and the source of the third thin film transistor both are connected to the drain of the fourth thin film transistor, and the source of the fourth thin film transistor is grounded; and the drain of said second thin film transistor is also connected to an end of the storage capacitor, the other end of said storage capacitor is grounded, and said storage capacitor and said holding capacitor are connected in parallel, wherein the gate of said second thin film transistor is connected to a video synchronization signal, the gate of said third thin film transistor is connected to a zero clearing signal, and the gate of said fourth thin film transistor is connected to a grounding control signal.

2. The field sequential liquid crystal display device according to claim 1, wherein a relationship between a pixel electrode voltage and an output voltage is:

$$V_1' = \frac{V_2 C_{fb}}{C_{fb} + C_{st} + C_{lc}};$$

wherein $V_1'$ is the pixel electrode voltage, $V_2$ is the output voltage, $C_{fb}$ is the capacitance of the frame buffer capacitor, $C_{st}$ is the capacitance of the storage capacitor, and $C_{lc}$ is the capacitance of the holding capacitor.

3. A field sequential liquid crystal display device, wherein a pixel structure of the device comprises: a first thin film transistor, a second thin film transistor, a third thin film transistor, a fourth thin film transistor, each having a gate, a source, and a drain; a frame buffer capacitor; a storage capacitor; and a holding capacitor;

wherein the gate of said first thin film transistor is connected to a gate line, the source of said first thin film transistor is connected to a data line, and the drain of said first thin film transistor is connected to the source of the second thin film transistor;

the source of said second thin film transistor is connected to an end of the frame buffer capacitor, and the drain of said second thin film transistor is connected to the drain of the third thin film transistor;

the other end of said frame buffer capacitor and the source of the third thin film transistor both are connected to the drain of the fourth thin film transistor, and the source of the fourth thin film transistor is grounded; and the drain of said second thin film transistor is also connected to an end of the storage capacitor, the other end of said storage capacitor is grounded, and said storage capacitor and said holding capacitor are connected in parallel, wherein said second thin film transistor and said fourth thin film transistor are in a cut-off state, and the gate of said third thin film transistor is connected to the gate line and receives a scanning signal.

4. The field sequential liquid crystal display device according to claim 3, wherein a relationship between a pixel electrode voltage and an output voltage is:

$$V_1' = \frac{V_2 C_{fb}}{C_{fb} + C_{st} + C_{lc}};$$

wherein $V_1'$ is the pixel electrode voltage, $V_2$ is the output voltage, $C_{fb}$ is the capacitance of the frame buffer capacitor, $C_{st}$ is the capacitance of the storage capacitor, and $C_{lc}$ is the capacitance of the holding capacitor.

5. The field sequential liquid crystal display device according to claim 1, wherein said grounding control signal is logic OR between a scanning signal and the zero clearing signal.

6. A method for driving a field sequential liquid crystal display device wherein a pixel structure of the field sequential liquid crystal display device comprises: a first thin film transistor, a second thin film transistor, a third thin film transistor, a fourth thin film transistor, each having a gate, a source, and a drain; a frame buffer capacitor; a storage capacitor; and a holding capacitor;

wherein the gate of said first thin film transistor is connected to a gate line, the source of said first thin film transistor is connected to a data line, and the drain of said first thin film transistor is connected to the source of the second thin film transistor;

the source of said second thin film transistor is connected to an end of the frame buffer capacitor, and the drain of said second thin film transistor is connected to the drain of the third thin film transistor;

the other end of said frame buffer capacitor and the source of the third thin film transistor both are connected to the drain of the fourth thin film transistor, and the source of the fourth thin film transistor is grounded; and the drain of said second thin film transistor is also connected to an end of the storage capacitor, the other end of said storage capacitor is grounded, and said storage capacitor and said holding capacitor are connected in parallel, the method comprises:

providing a grounding control signal for the gate of the fourth thin film transistor;

providing a scanning signal for the gate of the first thin film transistor, providing a data signal for the source of the first thin film transistor, and performing frame scanning;

providing a zero clearing signal for the gate of the third thin film transistor to clear a pixel electrode voltage after finishing one frame scanning; and providing a video synchronization signal for the gate of the second thin film transistor to display an image after finishing the zero clearing.

7. The method according to claim 6, wherein the grounding control signal is logic OR between the scanning signal and the zero clearing signal.

8. A method for driving a field sequential liquid crystal display device, wherein a pixel structure of the field sequential liquid crystal display device comprises: a first thin film transistor, a second thin film transistor, a third thin film transistor, a fourth thin film transistor, each having a gate, a source, and a drain; a frame buffer capacitor; a storage capacitor; and a holding capacitor;

wherein the gate of said first thin film transistor is connected to a gate line, the source of said first thin film transistor is connected to a data line, and the drain of said first thin film transistor is connected to the source of the second thin film transistor;

the source of said second thin film transistor is connected to an end of the frame buffer capacitor, and the drain of said second thin film transistor is connected to the drain of the third thin film transistor;

the other end of said frame buffer capacitor and the source of the third thin film transistor both are connected to the drain of the fourth thin film transistor, and the source of the fourth thin film transistor is grounded; and the drain of said second thin film transistor is also connected to an end of the storage capacitor, the other end of said storage capacitor is grounded, and said storage capacitor and said holding capacitor are connected in parallel, the method comprises:

providing a scanning signal for the gate of the first thin film transistor, providing a data signal for the source of the first thin film transistor, and providing the scanning signal for the gate of the third thin film transistor.

9. The method according to claim 6, wherein a relationship between the pixel electrode voltage and an output voltage is: $V_1'=V_2C_{fb}/C_{fb}+C_{st}+C_{lc}$;

wherein $V_1'$ is the pixel electrode voltage, $V_2$ is the output voltage, $C_{fb}$ is the capacitance of the frame buffer capacitor, $C_{st}$ is the capacitance of the storage capacitor, and $C_{lc}$ is the capacitance of the holding capacitor.

10. The method according to claim 8, further comprising switching said second thin film transistor and said fourth thin film transistor in a cut-off state.

11. The method according to claim 10, wherein a relationship between a pixel electrode voltage and an output voltage is: $V_1'=V_2C_{fb}/C_{fb}+C_{st}+C_{lc}$;

wherein $V_1'$ is the pixel electrode voltage, $V_2$ is the output voltage, $C_{fb}$ is the capacitance of the frame buffer capacitor, $C_{st}$ is the capacitance of the storage capacitor, and $C_{lc}$ is the capacitance of the holding capacitor.

* * * * *